United States Patent [19]

DeWitt et al.

[11] Patent Number: 4,968,963

[45] Date of Patent: Nov. 6, 1990

[54] THERMOSTAT WITH PILOT LIGHT SWITCH

[75] Inventors: Stuart L. DeWitt; William I. Sanders, both of Morris, Ill.

[73] Assignee: Bimet Corporation, Morris, Ill.

[21] Appl. No.: 432,082

[22] Filed: Nov. 6, 1989

[51] Int. Cl.[5] ..... H01H 37/52; H01H 37/12

[52] U.S. Cl. ..... 337/363; 337/368; 219/248

[58] Field of Search ..... 337/368, 347, 376, 37, 337/57, 82, 94, 334, 337, 41, 42, 43, 363; 219/506, 248, 453

[56] References Cited

U.S. PATENT DOCUMENTS 2,527,767 10/1950 Schmidt ..... 219/248

3,936,786 2/1976 Peterson et al. .

*Primary Examiner*—H. Broome

*Attorney, Agent, or Firm*—Kinzer, Plyer, Dorn, McEachran & Jambor

[57] ABSTRACT

A thermostat for controlling the electrical heating element of an appliance has a user-activated control shaft for controlling the overall operation of the appliance. The thermostat includes a first switch controllable by a temperature sensing element for turning the heating element on and off. When the control shaft is turned to an off position, the shaft disables the operation of the first switch, maintaining it in an open condition. The thermostat also has a second switch which operates a pilot light for indicating when the appliance is on. The second switch is continuously open when the control shaft is in the off position and continuously closed when the control shaft is in an on position.

12 Claims, 1 Drawing Sheet

THERMOSTAT WITH PILOT LIGHT SWITCH

SUMMARY OF THE INVENTION

This invention relates to thermostats for controlling the operation of portable electric heaters and other appliances. The thermostats used in such appliances have typically been single pole devices. Peterson U.S. Pat. No. 3,936,786 is an example. Recently, it has become desirable, and in some cases required, to have a pilot light on some of these appliances, indicating when the appliance is on. However, the pilot light cannot be switched by the same pole as the load, because the requirement is that if the appliance is on, the pilot light must stay lit, even if the contacts for the heating element have cycled off under the control of a temperature sensing element to maintain temperature.

The present invention is a thermostat which, in addition to providing temperature-governed switch for control of a heating element, has a second switch, independent of the first switch, which controls the operation of a pilot light. A user-actuatable control means is movable between an off position wherein both switches are held in an open condition, and an on position wherein the pilot light switch is continuously closed and the heating element switch is opened and closed by a temperature sensing element.

A primary object of the invention is a thermostat of the type described having a simple, inexpensive arrangement for supplying the pilot light contacts.

Another object of the invention is a thermostat of the type described which adds only a single pilot light blade to existing single pole thermostats to provide a pilot light contact which is independent of the temperature-governed contacts of the thermostat.

Another object of the invention is a thermostat which can be formed in a stack.

Other objects may appear from time to time in the following description and claims.

DETAILED DESCRIPTION OF THE INVENTION

Figure 1:
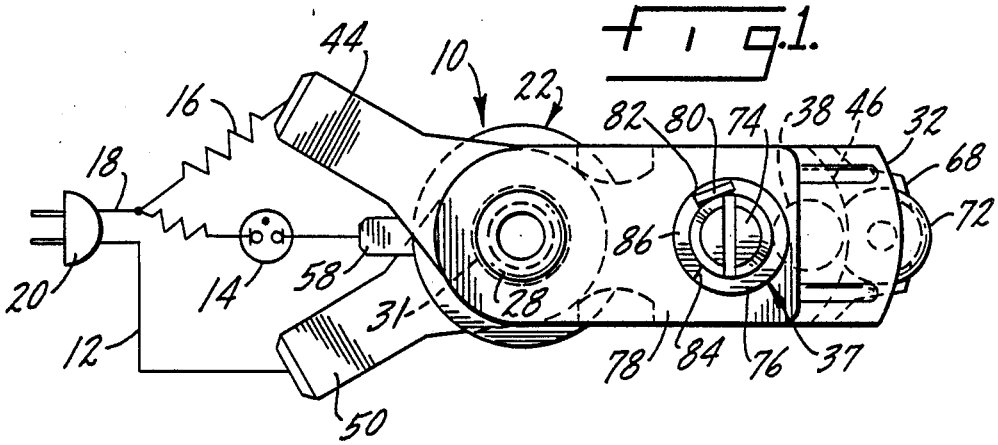
FIG. 1 is a plan view of the thermostat according to the present invention.
Figure 2:
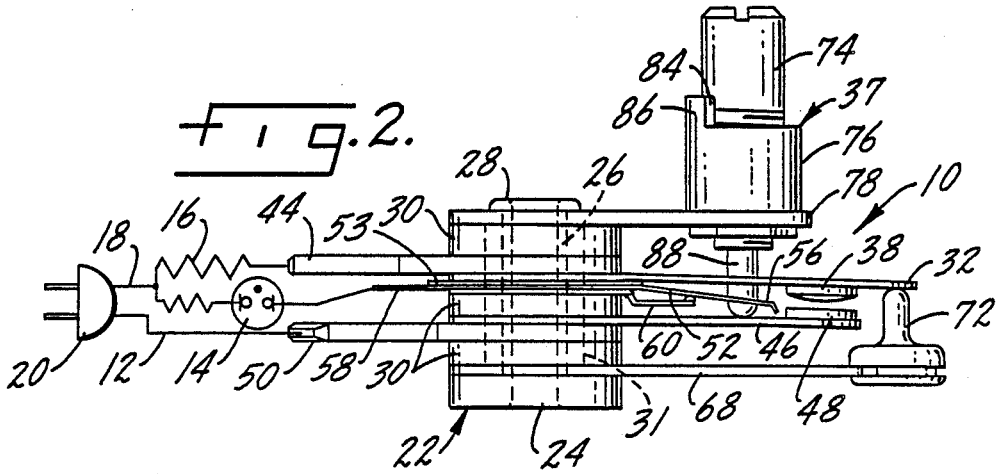
FIG. 2 is a side elevation view of the thermostat.

FIGS. 1 and 2 illustrate the thermostat of the present invention and include diagrammatic indications of its operating environment. The thermostat is shown generally at 10. It is connectable to a power line 12, a pilot light 14, such as a neon bulb, and a heating element 16. The heating element may be for a portable heater or other appliance. The pilot light 14 and heating element 16 are joined to line 18. Power line 12 and line 18 are connected to a plug 20, which is in turn connectable to a power supply (not shown).

The thermostat itself comprises a base member, indicated generally at 22. The base member includes a rivet having a head 24, a shank 26 and a swaged end 28. The shank of the rivet extends through openings in the ends of the contact blades to hold the blades and spacers together in a stack. The base member also has a plurality of dielectric spacers 30. The spacers are placed between the various blade members to electrically isolate them. The spacers may be made of ceramic material or other non-conductive material. A dielectric tube 31 is disposed about the shank 26 of the rivet to insulate the blade members from the shank.

Figure 3:
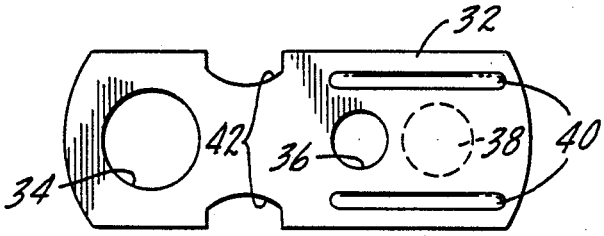
FIG. 3 is a plan view of the first blade of the thermostat.

The thermostat includes a first blade 32 which is attached to the base member 22. Details of the first blade 32 are shown in FIG. 3. The blade has a hole 34 through which the rivet shank 26 and tube 31 extend. A second opening 36 is provided for passage of a portion of a control means. The control means is shown generally at 37 in FIG. 2. Details of the control means will be described below. On the underside of the first blade is a contact pad 38. Stiffening ribs 40 may be embossed in the blade if desired. Cutouts 42 are located near the attachment of the blade to the base. Varying the size of the cutouts controls the flexibility of the blade. The cutout determines the bend line as well as the flexibility.

The first blade is electrically connectable to the heating element 16 by a first tab 44. The tab is connected to the heating element 16. As seen in FIG. 2, the tab 44 is located directly on top of the first blade 32 in the base member stack. Thus, it is electrically connected to the first blade 32.

A second blade 46 is attached to the base member 22 and biased toward the first blade. The second blade has a contact pad 48 disposed opposite the pad 38 of the first blade 32. The pads 38 and 48 are electrically conductive. They are shown in their open position. This is under the influence of the control means 37. The first and second blades are arranged to have a natural bias toward one another. Thus, it can be seen that when not held apart by the control means 37 (or the nose of the bimetallic blade to be described below), the natural bias of the first and second blades 32 and 46 urges them into contact with one another.

The second blade is connectable to the electrical power source by means of a second tab 50. The tab 50 is located directly beneath the second blade 46 in the base member 22. Thus, the tab 50 and blade 46 are in contacting, electrically conducting relation.

A pilot light blade 52 is attached to the base member 22. It is insulated from the first blade 32 by a dielectric washer 53. The pilot light blade 52 is shown in FIG. 2 in the open condition, due to the influence of the control means 37 on the second blade 46. However, the pilot blade is biased toward the second blade. It will be understood that this bias will cause the pilot blade to contact the second blade when the control means is retracted.

Figure 4:
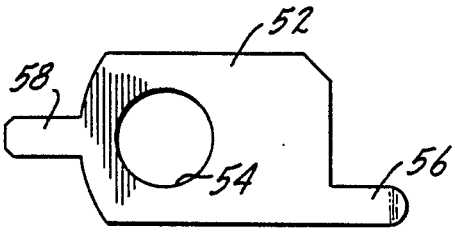
FIG. 4 is a plan view of the pilot light blade.

Details of the pilot light blade 52 are shown in FIG. 4. Blade 52 has an opening 54 for the rivet and tube of the base member. It also has a finger 56 extending from one edge thereof. And the pilot blade has a pilot tab 58 extending therefrom for connection to the pilot light 14.

Figure 5:
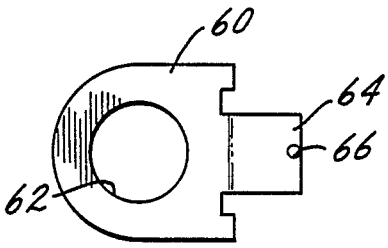
FIG. 5 is a plan view of the adjusting blade.

The bias of the pilot blade toward the second blade is governed by an adjusting blade 60. Details of the adjusting blade are shown in FIG. 5. As with the other blades, the adjusting blade has an opening 62 for receiving the base member rivet and tube. The adjusting blade also has a projection 64 which carries a tip 66. As seen in FIG. 2, the tip serves as a fulcrum for the pilot blade 52. Thus, the length of the projection 64 controls the flexing motion of the pilot blade. The projection 64 is adjusted so that the finger 56 of the pilot blade is spaced from the second blade 46 when the control means 37 is in the off position.

Figure 6:
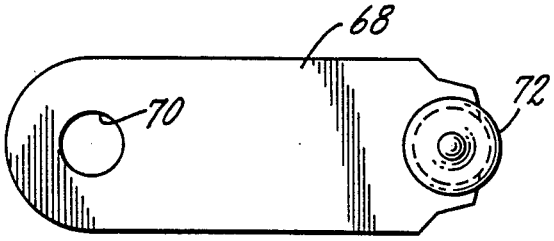
FIG. 6 is a plan view of the bimetallic blade.

A temperature-sensitive element in the form of a bimetallic blade 68 is attached near the bottom of the base member. As seen in FIG. 6, the bimetallic blade has an opening 70 near one end and an insulative nose 72 attached at its other end. As seen in FIG. 2, the nose 72 extends into contact with the end of the first blade 32. The bimetallic blade 68 is located in the appliance in a position where it is exposed to the temperature of the heating element. Thus, when the control means is in the on position, the bimetallic blade will govern the contact between the pads 38 and 48 of the first and second blades. This makes and breaks the contact between the power source and the heating element.

The control means 37 is a sub-assembly which includes a shaft 74 threaded in a nozzle 76. The nozzle is mounted on a rigid arm 78 which is attached to the base member 22. The shaft 74 has an abutment 80 attached to its circumference. The abutment is engageable with surfaces 82 and 84 of a wall 86 (FIG. 1) formed in the nozzle. The abutment limits rotational movement of the shaft 74. The lower end of the shaft 74 is connected to a non-conductive stop 88. The stop protrudes through opening 36 in the first blade into contact with the second blade, as seen in FIG. 2. The stop 88 is disposed behind the finger 56 of the pilot blade, as seen in FIG. 2.

It will be understood that additional optional elements, not shown in this embodiment, could be used with the described thermostat. For example, an anticipating heater blade and/or a positive off bimetal could be added to the thermostat shown.

The use, operation and function of the thermostat are as follows. The shaft 74 of the control means 37 can be moved by the appliance user between an off position and an on position. In the off position, the stop 88 holds the second blade 46 out of contact with the first blade 32 and out of contact with the pilot blade 52. This is the condition shown in FIG. 2. In effect, the stop 88 disables the first switch formed by contact pads 38 and 48, and opens the second switch formed by the finger 56 and second blade 46.

When the user moves the shaft 74 of the control means 37 to the on position, the stop 88 is retracted, allowing the bias in the second blade 46 to move it upwardly (as seen in FIG. 2) and cause contact between the second blade and the finger 56 of the pilot blade. Contact may also be made between the pads 38 and 48. Contact between the pads is made only if permitted by the bimetallic blade 68. In any case, upon retraction of the stop 88, the condition of the bimetallic blade becomes the governing factor in the opening and closing of the contacts 38 and 48. It is pointed out that when the control means is in the on position, the pilot blade 52 is in continuous contact with the second blade 46. This contact is independent of the temperature-governed relationship between the first and second blades.

Under normal ambient temperature conditions, when the user returns the shaft 74 to the off position, the action of the bimetallic blade is disabled. The bimetallic blade is no longer able to permit contact between the first and second blades because the stop 88 holds the second blade 46 out of contact with the first. Also, with the control means 37 in the off position, the adjusting blade 60 holds the pilot blade out of contact with the depressed second blade, thereby disconnecting the pilot light from the power source.

It can be seen that the described construction provides an electrical circuit to the pilot light 14 whenever the control means is in the on position. This circuit is independent of the condition of the circuit to the heating element 16. Thus, the bimetallic blade may cycle the heating element on and off, but the pilot light will remain on so long as the control means is in the on position. When the control means is moved to the off position, both the pilot light and heating element circuits are held fixed in an open condition.

Whereas a preferred form of the invention has been shown and described, it will be realized that alterations may be made thereto without departing from the scope of the following claims.

We claim:

1. A thermostat for controlling an electrical heating element of an appliance, comprising:

a base member;

a first blade attached to the base member and electrically connectable to the heating element;

a second blade attached to the base member and electrically connectable to an electric power source, the first and second blades being biased toward one another;

a pilot light blade attached to the base member between the first and second blades and biased toward said second blade, the pilot light blade being electrically connectable to a pilot light for indicating when the appliance is on;

temperature-sensing means attached to the base member and having a projection engageable with the first blade, the projection being movable in response to temperature changes;

control means attached to the base member and engaging the second blade, the control means being movable between an off position wherein said control means holds the second blade out of contact with the first blade and the pilot blade, and an on position wherein said control means allows the bias of the pilot light blade to produce continuous contact between the second blade and the pilot blade and wherein the control means allows temperature-governed contact between the first and second blades, said temperature-governed contact being determined by the condition of the temperature-sensing means; and an adjusting blade attached to the base member and disposed between the pilot light blade and the second blade, the adjusting blade having an extension which engages the pilot light blade to control the flexing of the pilot light blade and hold it out of contact with the second blade when the control means is in the off position.

2. The thermostat of claim 1 wherein the base member comprises a plurality of insulating members disposed between the blades to electrically isolate them from one another at the base, and a rivet extending through the blades and insulating members.

3. The thermostat of claim 1 further comprising first and second tabs electrically connected to the first and second blades, respectively, and extending from the base member to provide attachment elements for a heating element and power source.

4. The thermostat of claim 1 further comprising a pilot tab electrically connected to the pilot light blade and extending from the base member to provide an attachment element for a pilot light.

5. The thermostat of claim 1 wherein the control means is mounted on relatively rigid arm extending from the base member.

6. The thermostat of claim 5 wherein the temperature-sensing means comprises a bimetallic blade.

7. The thermostat of claim 6 wherein the first and second blades are disposed between the rigid arm and the bimetallic blade, with the second blade being biased toward the rigid arm.

8. The thermostat of claim 7 wherein the first blade has an opening through which the control means extends toward the second blade.

9. The thermostat of claim 8 wherein the pilot light blade has a finger adjacent to the control means and spaced therefrom.

10. The thermostat of claim 1 wherein the temperature-sensing means comprises a bimetalic blade.

11. The thermostat of claim 5 wherein the control means comprises a nozzle attached to the rigid arm and a shaft threaded in the nozzle.

12. A thermostat for controlling an electrical heating element of an appliance, comprising temperature-sensing means, first and second contacts biased toward one another in either contacting or non-contacting relation as governed by the temperature-sensing means, one of the contacts being connectable to an electrical power supply, a pilot light connected in a parallel circuit with the electrical heating element, a pilot contact between the first and second contacts and biased toward engagement with the contact connectable to the power supply, the pilot contact being connected to said pilot light, and control means for selectively turning off the appliance by disengaging the pilot and power contacts and disabling the operability of the temperature-sensing means to govern the relation of the first and second contacts by maintaining the first and second contacts in spaced relation and by maintaining the pilot contact and the contact connectable to the power supply in spaced relation.

* * * * *